United States Patent [19]

Boyd, Sr. et al.

[11] Patent Number: 4,961,239

[45] Date of Patent: Oct. 9, 1990

[54] FIXED YET PIVOTABLE KNIFE OR TOOL

[75] Inventors: Frank M. Boyd, Sr., Saugus; Francis M. Boyd, Jr., San Francisco, both of Calif.

[73] Assignee: F. Boyd, Ltd., Limited Partnership, San Francisco, Calif.

[21] Appl. No.: 234,608

[22] Filed: Aug. 22, 1988

[51] Int. Cl.[5] ..... B25F 1/04

[52] U.S. Cl. ..... 7/118; 7/151; 7/158; 7/168

[58] Field of Search ..... 7/118, 168, 158, 151, 7/156; 30/155, 160, 161, 158, 151

[56] References Cited

U.S. PATENT DOCUMENTS

| | | | |
|---|---|---|---|
| 300,858 | 6/1884 | Feicker, Jr. | 7/168 |
| 1,036,664 | 8/1912 | Marble | 7/168 |
| 1,039,260 | 9/1912 | Cooper | 7/118 |

FOREIGN PATENT DOCUMENTS

| | | | |
|---|---|---|---|
| 52170 | 6/1890 | Fed. Rep. of Germany | 30/160 |
| 24428 | of 1910 | United Kingdom | 30/155 |

*Primary Examiner*—Roscoe V. Parker
*Attorney, Agent, or Firm*—Frank L. Zugelter

[57] ABSTRACT

A knife or tool (10) comprising a member (11) with a blade (12) and tool element (14) thereon, pivotable at (40) whereby one or the other, blade (12) or tool element (14), is correspondingly disposed in a sheath (22) while the other is exposed. Scales (16, 17) are mounted to each side (20, 21) of the member (11) and encompassed within its sheath (22), while an urging means (54, 55) or spring mechanisms are mounted between the member (11) at its pivot point (40) and the scales (16, 17). In the pivoting motion, studs (65), of pairs of studs (65, 66) correspondingly mounted on both sides (20, 21) of the member (11) at particular points, are caused to be released from their bayonet slots (62) in the scales (16, 17) against the prejudicing action of the spring mechanisms (54, 55) which nevertheless yield as a third pair of studs (72) simultaneously released from open-ended slots (68) in the frontal ends of their scales (16, 17) move the member's pivoting action along camming surfaces (73) on the frontal ends of the scales (16, 17). The third pair of studs (72) are received in another set of open-ended slots (69) on the scales' frontal ends. The second pair of studs (66) correspondingly mounted on both sides (20, 21) of the member (11) at another particular point also reach another set of bayonet slots (62) in the scales (16, 17) to be retained therein by such prejudicing action. A clip member (36) is mounted to either side of the sheath (22), depending upon the user's desires. The tool element (14) itself is an additional tool, such as a can opener (78), screw driver, etc., thus making the assembly of elements adaptable as well to other tools in addition to knives.

42 Claims, 6 Drawing Sheets

11
12
13
14
15
16
17
21
24
25
27
28
29
30
32
33
34
37
39
40
41
42
43
44
45
46
48
51
62
63
64
65
66
68
69
72
73
76
85
86
87
88
90
91
92
93
94
95

FIXED YET PIVOTABLE KNIFE OR TOOL

TECHNICAL FIELD

This invention relates to a tool, and particularly is directed to a pivotable knife or other tool. It may be considered by some as associated with hunting knives, pocket knives, jack knives, and the like, however, its uniqueness of construction and nature signals the advent of a new kind of tool and/or assembly therefor.

BACKGROUND ART

Disclosures of knives are found in the following prior art teachings: U.S. Pat. Nos.: 1,056,404; 2,924,879; 4,541,175; and 4,703,560; also see the teachings to be found in *Levine's Guide To Knives And Their Values*, published in 1985 by DBI Books, Inc., 4092 Commercial Avenue, Northbrook Ill. 60062, U.S.A.

DISCLOSURE OF THE INVENTION

A. Research and development towards arriving at the instant invention was directed in a manner to provide adaptation of manufacture to mass production of a knife and to a tool incorporating the invention, and at the same time to achieve a tool that would be the safest in service or use. Further, a purpose of the invention that was sought was to create an inexpensive, fixed-bladed knife the handle of which could be easily rotated around over the blade to become its sheath. Further, when the handle would act as the sheath, a tool element on the knife or tool would be exposed and would provide the option for a second or combination function, an example of which being a bottle opener. Lastly, it was sought that the handle have a facility for attaching the knife or tool to the person, i.e., via a clip or lanyard hole.

B. Advantages of the invention. The invention of this knife has a mechanical strength not reached in a conventional folding knife, because in all folding knives, their spring-like backs are relatively weak when the blades are in open mode, i.e., their cutting edges exposed. Further, there is the elimination of a dangerous blade folding procedure that is associated with conventional knives, such as with a Buck (brand) knife, whereby one's fingers are across the sheath's slot for the blade just prior to introduction of the blade into the sheath's slot. In this invention, both hands and fingers are not exposed to a dangerous setting across the sheath's slot for the blade. Also, the addition of a second tool upon or incorporated within the tool element makes a combination tool out of this invention, a tool that is able to fulfill a dual purpose rather than simply being a knife or single tool. Further, the assembly of this device provides for the basis of utilizing it, not only in a knifing environment, but also for adaptation to other kinds of tools.

C. Summary of The Invention. The invention is manifest in a knife comprising a member having a blade and a tool element, and a prejudicing means or mechanism for the member which urges it always toward a locked position whether blade or tool element is exposed from the handle or sheath, while the other of the two is encompassed within the handle or sheath of the knife. Means to overcome or otherwise causing such urging to yield during the pivoting to change the directions of blade and tool element also is provided. A scale or plate is mounted along each side of the member while a handle side is correspondingly mounted over each such scale so as to generate the sheath or handle for the knife. A pair of coiled springs operatively connect the knife's member, at its pivot axis, and the scales whereby such member is urged towards the locked position irrespective of the particular directions for the blade and for the tool element. A slot is provided in the scales at the pivot axis for the member so that during its pivoting, the urging of the coiled springs is overcome as the member slides in an opposite direction by reason of a camming action on it. The locked position is achieved by one of a pair of studs mounted on each side of the member engaging a bayonet slot formed in one of the edges upper or lower, of its corresponding scale. After pivoting of the member, whereby the directions of blade and tool element are changed, the other of the pair of studs on each side of the member engages a bayonet slot correspondingly formed in the other of such edges of its corresponding scale. A third stud, intermediately disposed between the pair of studs on each side of the member, seats in one or the other of two open-ended slots formed in the front end or terminus of each scale, depending upon which corresponding studs on both sides of the member are seated in their corresponding bayonet slots in the scales. When either the exposed tool element or blade is grasped by and pulled away from the sheath by the user in order to change their directions by pivoting the member, the third or intermediatly disposed studs on both sides of the member exit from their open-ended slots to co-operatively engage camming rails mounted on the frontal end of the scales between such open-ended slots. Such camming overcomes the urging of the springs which yield to such camming action. As the coiled springs yield, the member easily rotates in its rotary or pivotal motion, as such intermediately disposed studs engage their corresponding camming rails, to change the directions for blade and tool element and again the member is locked to its sheath upon completion of its rotation by the one-way urging of the coiled springs. An alternative embodiment provides for bow spring mechanisms mounted on longitudinally-disposed drawbars slidably mounted to the sides of the member to yieldingly urge the pairs of studs on the member to seat in the bayonet and open-ended slots of the scale, thereby causing a locked position for the knife's member regardless of the directions which blade and tool element have taken. Also, sword-like hilt projections on the member protect the user's hand from slipping onto its exposed knife blade during a forward thrust of the knife.

D. Objects Of The Invention.

An object of this invention is to provide a uniquely conceived and novel hand tool mechanism or assembly adaptable not only for a knife, but also for use with other kinds of tools mountable to their sheaths.

Another object of the invention is to eliminate the danger of injuring one's hand or fingers during the pivoting procedure for the blade, as is the case with conventional knife blades foldable into their sheaths.

A further object of this invention is to provide a knife or other tool having a mechanical strength not heretofore achieved in any folding knife, tool or the like.

Still a further object of the invention is to provide an inexpensive, fixed-bladed knife or tool the main member of which is easily rotated or pivoted about the sheath of the knife.

Another object of the invention is to provide a safety feature against harm by including sword-like hilts obstructing the user's hand during a thrust of the exposed knife blade.

Another object of the invention is to provide interchangeability in an assembly of elements as well as readily adapting them to mass production techniques.

A further object of the invention is to provide a knife or other tool which will be the safest in their services to the user.

These and other objects and advantages of the invention will become more apparent by a full and complete reading of the following description, claims appended thereto, and the accompanying drawing comprising nine (9) Figures.

BEST MODE FOR CARRYING OUT THE INVENTION

Figure 1:
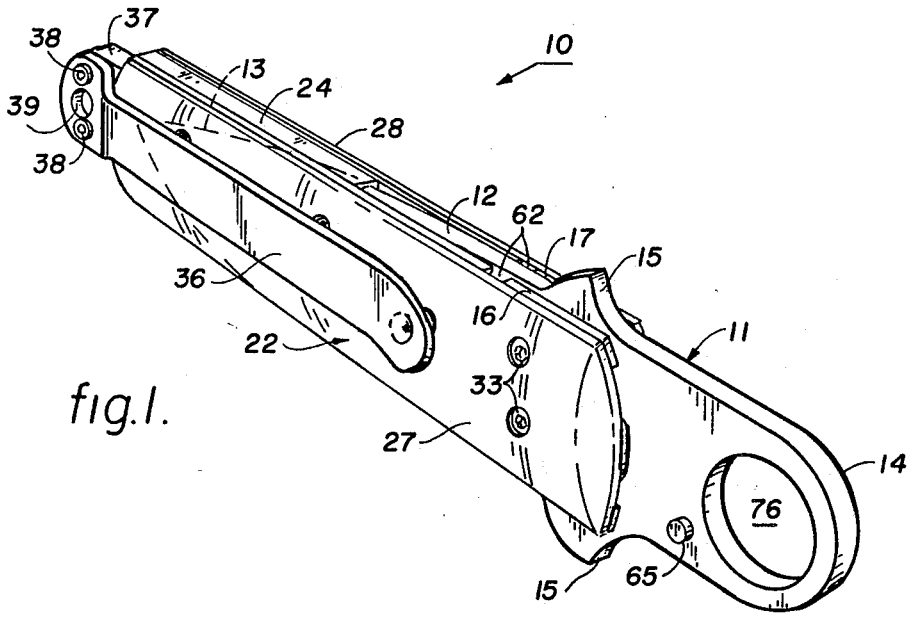
FIG. 1 is a perspective view of the invention manifest in a knife in its locked position.
Figure 2:
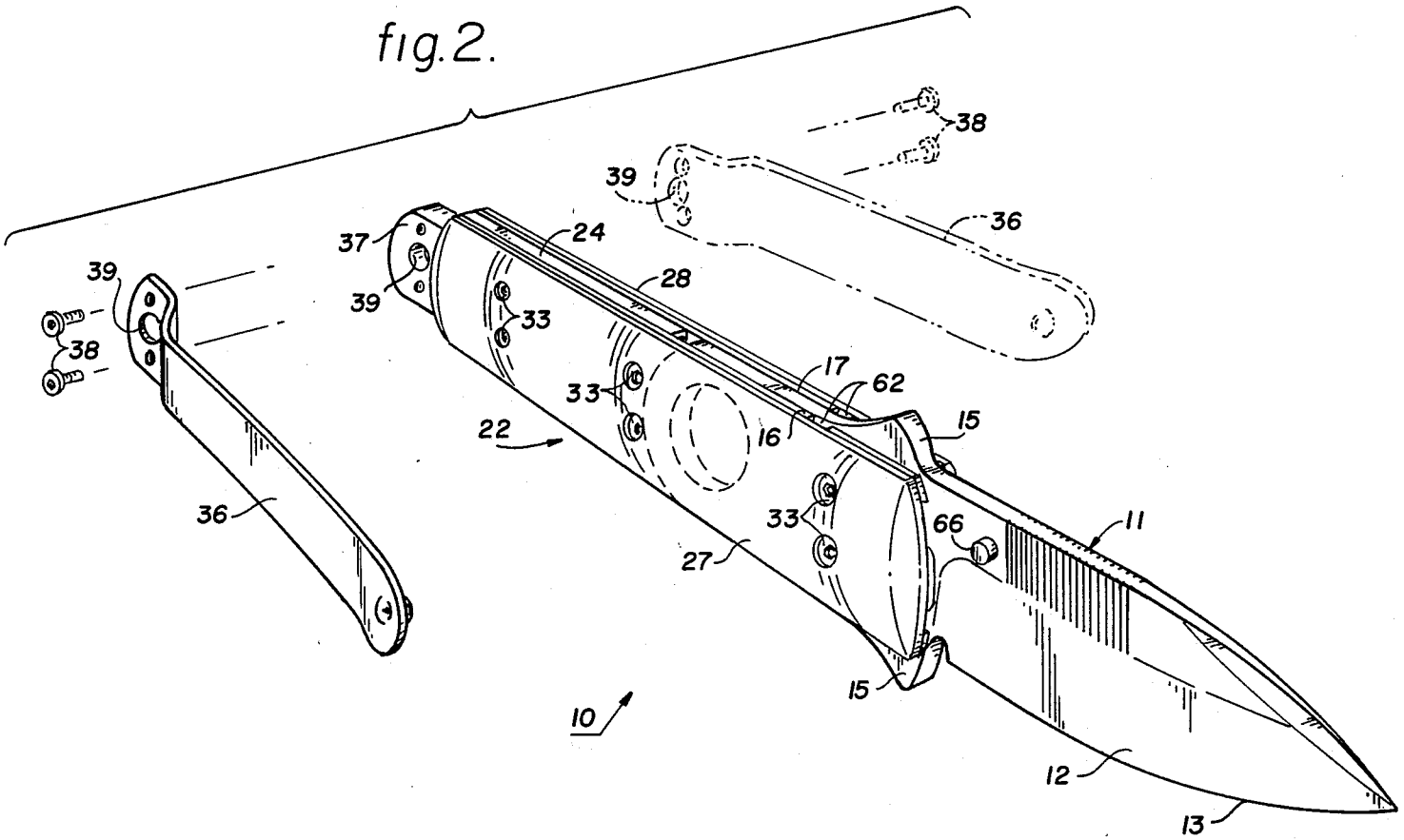
FIG. 2 is a perspective, partly exploded, view of such knife in its locked position but with knife blade exposed, its clip member shown in solid and phantom outlines.
Figure 3:
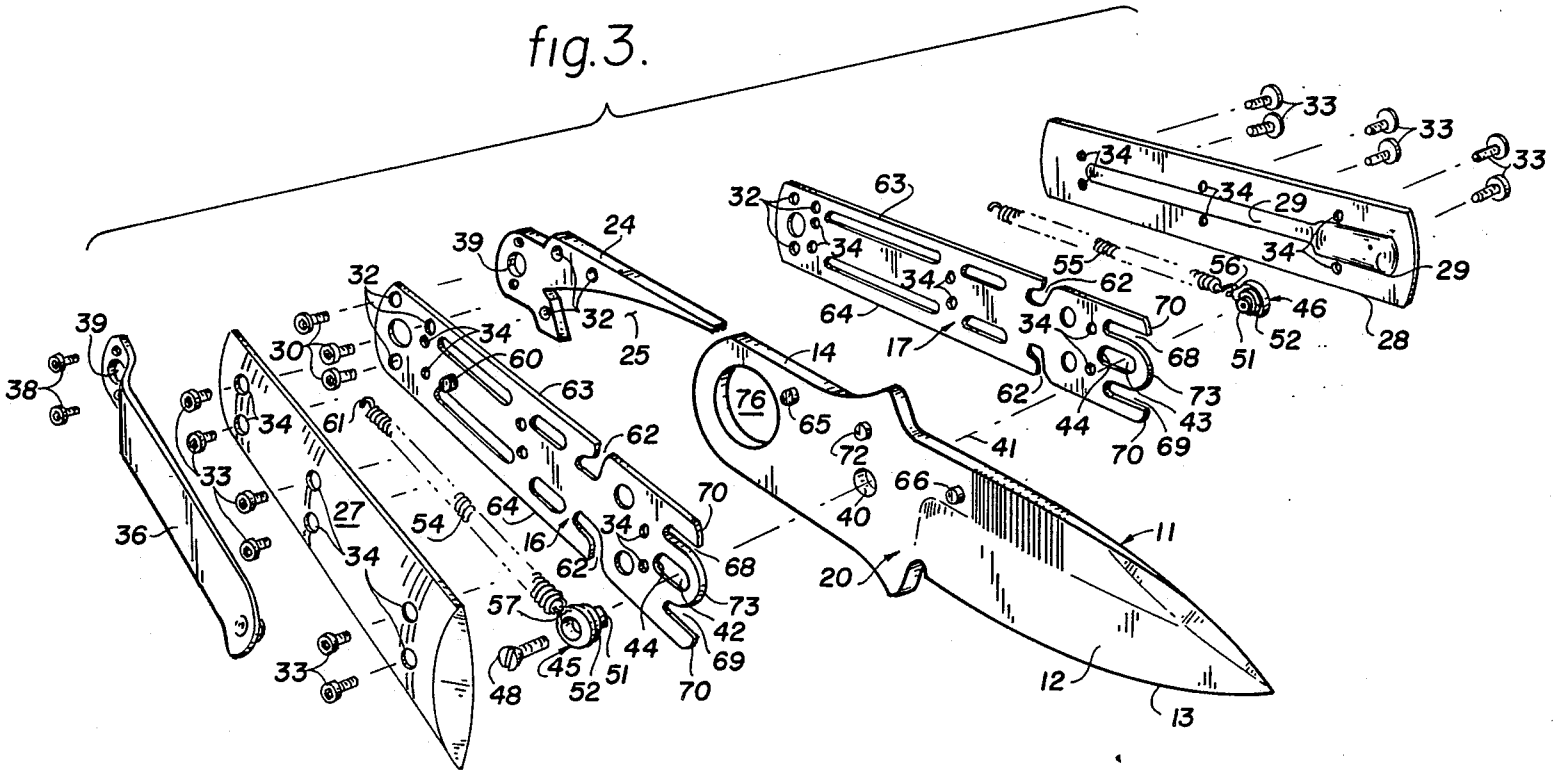
FIG. 3 is an exploded perspective view of the knife of FIGS. 1 and 2.

Referring now to the drawing wherein reference characters in the FIGURES correspond to like numerals hereinafter, FIGS. 1 and 2 illustrate the invention in a tool or knife 10 as it is shown in a locked position. Knife 10 comprises a member 11 which incorporates therein a blade 12 having a cutting edge 13 extending in one direction and a tool element 14 extending in an opposite direction to that of blade 12. A pair of oppositely extending hilts 15 are mounted at the base of blade 12 to prevent slipping of a user's hand in a forward thrust or action undertaken during the use of cutting edge 13. Each of a pair of scales 16, 17, FIG. 3, is mounted on and locates its corresponding side 20, 21 (FIG. 6) to member 11, and encompasses either its tool element 14 or its blade 12, when the direction of either tool element or blade is towards the sheath 22 for the tool or knife. A spacer 24 having the same thickness as member 11 is disposed between scales 16, 17, and extends forwardly towards member 11, while maintaining planar positions for such scales. Spacer 24 includes a recess 25 sufficient in size to provide access for blade 12 when its direction is towards it. Each of a pair of sheath or handle sides 27, 28 is mounted in turn upon its corresponding scale 16, 17, and are scalloped as at 29, visible in side 28 in FIG. 3, for proper disposition of urging means, illustrated in the drawing as spring mechanisms, to be described hereinafter. Allen-head screws 30 secure together scales 16, 17, and spacer 24 via corresponding tapped holes 32 in the scales and spacer 24, while pairs of spaced Allen-head screws 33 secure together sides 27, 28 to their adjacent, corresponding, or associated scales 16, 17 via corresponding counter-sunk and tapped holes 34 in the sides 27, 28 and scales 16, 17, respectively. A clip 36 is securely mounted to a projection 37 on spacer 24 and extends beyond the adjacent rear termini for scales 16, 17 by means of a pair of Allen-head screws 38 threaded into corresponding tapped holes in projection 37, while openings 39 also are provided in clip 36 and projection 37 in the event a lanyard is desired for hanging knife 10 thereto. Other types of fasteners, for example, rivets through scales and spacer, or flat-head screws counter-sunk into the scales and spacer, may be used, it being understood that the invention is not limited by the particular fasteners disclosed in the drawing.

It is to be noted from FIG. 2 that clip 36 also is securely mounted to projection 37 from the direction of handle side 28, as indicated by its phantom outline, thus providing versatility to the user of the knife, depending upon whether the knife is to be clipped to the one side or the other of the user's, say, waist.

Member 11 includes an aperture 40 having an axis 41 about which it pivots thereby providing for changing of directions of blade and tool element, one or the other thus being housed in the tool's sheath 22, FIG. 1. Scales 16, 17 are respectively provided with an opening or slot 42, 43, closed at their one extreme 44, longitudinally and centrally disposed thereof, and with which aperture 40 is in alignment. The lengths of the slots 42, 43 are longer than the size of aperture 40. A pair of facing cone-headed bushings 45, 46 are mounted to the elongated slots 42, 43, and into aperture 40, being secured to one another by a screw 48. Each cone-headed bushing 45, 46 includes a first or smallest collar 51 which slip fits to aperture 40 and a second or larger collar 52 part of which is slip-fit to and slidable within its corresponding slot 42, 43. Each of a pair of coiled springs 54, 55 includes a hook 56 attached to a tear-drop or looped steel wire 57 mounted in a groove (not visible) formed under the head of its bushing, while having its other end hooked to a stud 60 mounted on its corresponding scale 16, 17, as shown with respect to one of them in FIGS. 4*a*–4*d*. A hook could also be stamped out of each scale 16, 17 to accept the spring's rear hook 61. Consequently, although member 11 can move longitudinally of scales 16, 17 to the extent of the length of slots 42, 43, the prejudicing action of the coiled spring mechanisms urges it in a direction towards spacer 24.

Means for retaining member 11 in a locked position in either of its two directions for tool element and tool or blade 12 are provided. Bayonet slots 62 are formed at suitable points along the lengths of each of the opposing upper and lower edges 63, 64 of scale 16, 17. A pair of spaced studs 65, 66 are spacedly mounted along the length of each side of member 11 for cooperative engagement (receipt and release) respectively with one or the other of bayonet slots 62 on upper and lower edges 63, 64 on their corresponding scales 16, 17. A locked position for member 11 is established in either of its directions, first, by studs 65 engaging the seats in bayonet slots 62 on upper edges of scales 16, 17, or, second, by studs 66 engaging the seats in bayonet slots 62 on lower edges 64 of scales 16, 17.

A second set of slots 68, 69, open-ended, provides for additional strength for the locked position of member 11. Such a pair of slots 68, 69 is spacedly formed in each of the other termini or corresponding forward ends 70 of scales 16, 17. A stud 72 is mounted on each side of member 11, intermediately disposed between the studs 65, 66 on the same side of member 11, and cooperates with (by seating therein) each of the open-ended slots 68, 69 of its corresponding scale 16, 17, depending upon the directions at a given instance for the tool element and tool of member 11.

Means for overcoming the urging action of springs 54, 55 on member 11 during its pivotal or rotary motion about its axis 41 are provided. A camming surface or arcuate rail 73 is mounted on the forward end 70 of each of the scales 16, 17. Each stud 72 cooperatively engages its corresponding rail 73 to thereby slide member 11 forward, such springs yielding as member 11 pivots about its axis 41 in the operation of the invention.

Figure 4A:
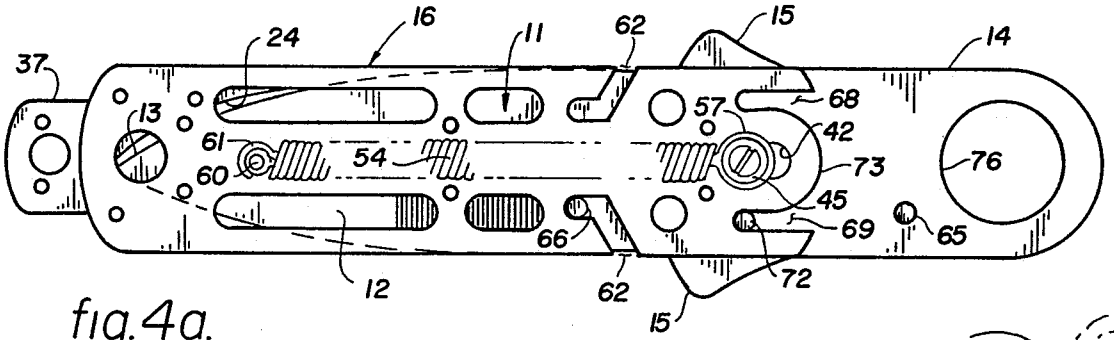
FIGS. 4*a*–4*d* are side elevational views, with sheath removed, illustrating the positions and motions for the knife's main member as it pivots to and from its locked position and into its changed directions.

In operation, referring to FIGS. **4*a*–4*d*, it will be observed in FIG. 4*a* that blade 11 is in its locked position within sheath 22 or in relation to the knife's scales 16, 17, with tool element 14 exposed. Studs 65, 66 seat within their bayonet slots 62 in lower edges 64 while studs 72 seat in open-ended slots 68, 69. The dual spring mechanisms, the coiled spring 54 of one of them being visible in FIG. 4*a*, urge or prejudice member 11 towards the rear end of the knife, i.e., towards projection 37, on spacer 24**.

Observing FIG. **4*b*, a finger 75 of a user inserted within a sufficiently large opening 76 in tool element 14 has pulled member 11 in the direction of arrow 77, showing stud (s) 66 to be free of their seats in the bayonet slots 62 in lower edges 64, while studs 72 have advanced from their seats in open-ended slots 68, 69 to a point along their scales 16, 17 at which corresponding ends of the guide rails 73 are located or begin. The springs 54, 55 have yielded to the pull of the user's fingers, the slots 42, 43 in their scales 16, 17 providing for such yielding as member 11 is pulled. The phantom outline of member and fingers show a partial rotation of member 11 relative to scales and sheath now that studs 66** are free of their bayonet seats.

FIG. **4*c* illustrates a continuing counter-clockwise motion for member 11, showing first a second phantom-lined view for member 11 with studs 72 (in phantom) slidingly engaging camming rails 73, and second, a solid-lined view of member 11 with studs 72 (in solid line) just off the camming rails 73 while studs 65, 66 have entered the catch of bayonet slots 62 on upper edges 63** but not yet seated therein.

FIG. **4*d* illustrates in its solid lines manual release by the user of member 11 so that studs 65 (66) now are seated in bayonet slots 62 in upper edges 63, while stud(s) 72 are seated in open-ended slot(s) 68, all of which being caused by the urging of springs 54, 55, and which provides for the locked position of member 11 of knife 10 in its sheath 22 and with its cutting edge 13** exposed.

Figure 4B:
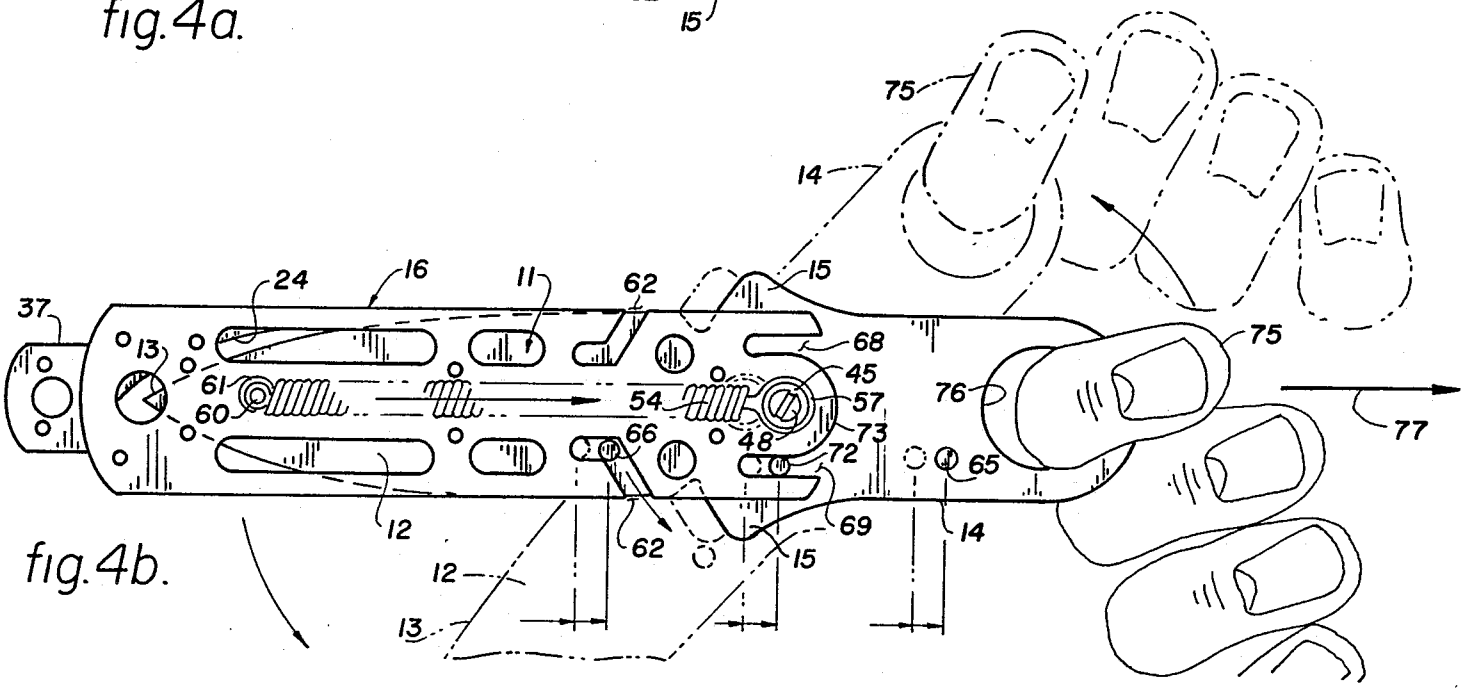
Figure 4C:
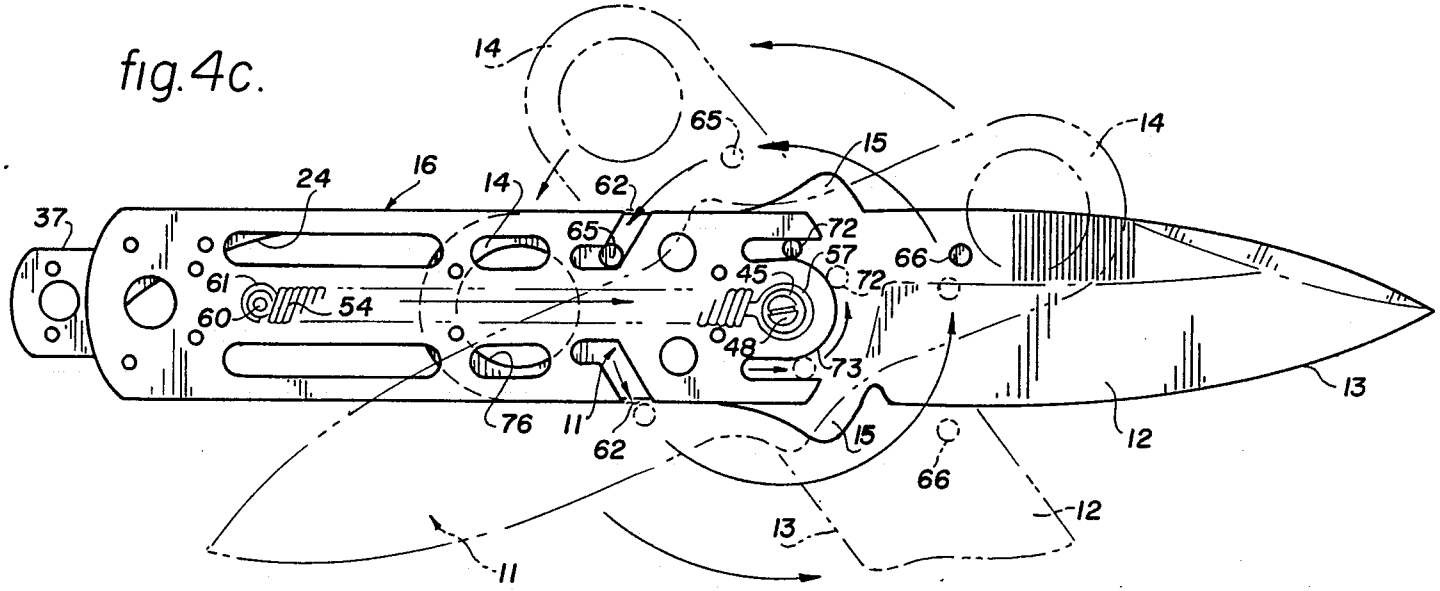
Figure 4D:
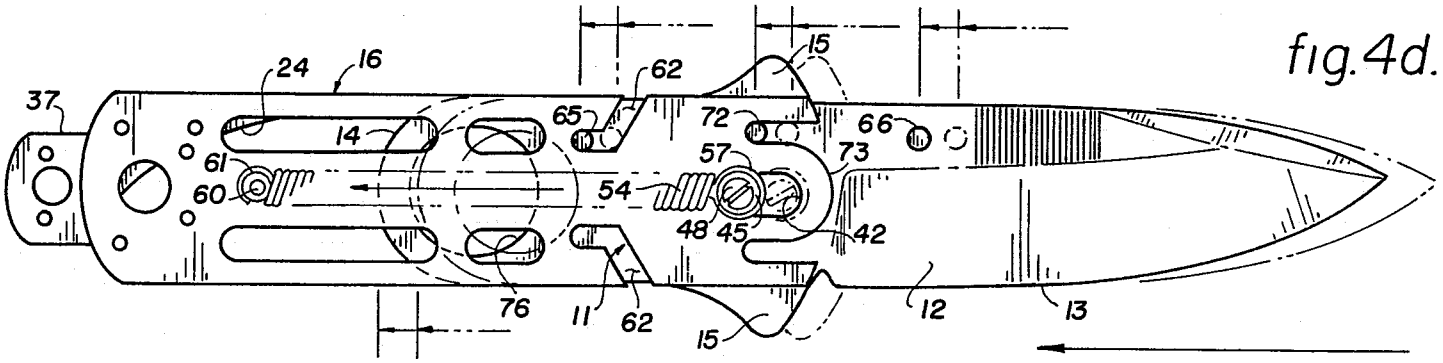

In a reverse cycle of operation, at FIG. **4*d* with cutting edge 13 exposed, blade member 11 is grasped and pulled forwardly of its sheath, to unseat studs 65, 72 from their respective slots, as shown in FIG. 4*c*, rotation thereafter being effected in a clock-wise manner to reach the FIG. 4*b* position prior to reaching locked position with tool element 14 exposed and as shown in FIG. 4*a***.

Figure 5:
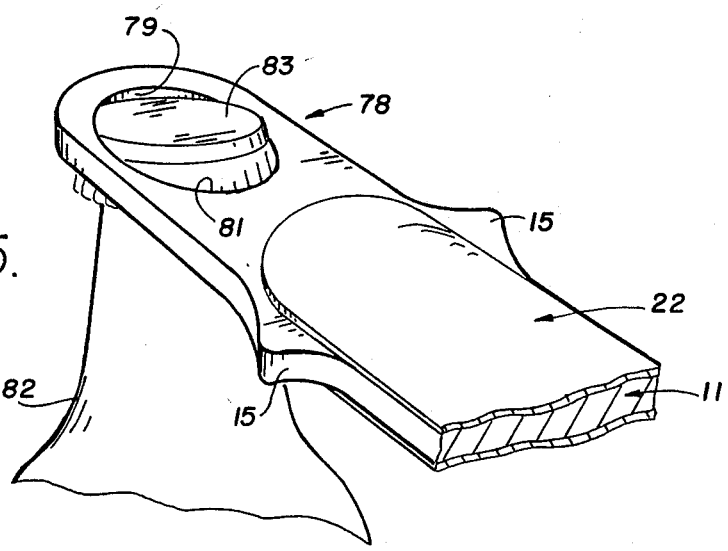
FIG. 5 is a perspective view illustrating the advantage of the incorporation of a tool within the tool element of the knife's member.

FIG. 5 illustrates utilization of a tang 14 as a tool 78 in and of itself. In the illustration, tool 78 assumes the configuration of a tang and includes an opening 79 configured into a conventional bottle cap opener 81 so that as applied to a bottle 82, particularly to its crowned cap 83, it prys off such cap. Thus, this illustrates the adaptability of the assembly mechanism to function as a support for a tool 78, example of which being opener 81, in addition to functioning as a foundation for (or other tool element) blade 12 of knife 10.

Figure 6:
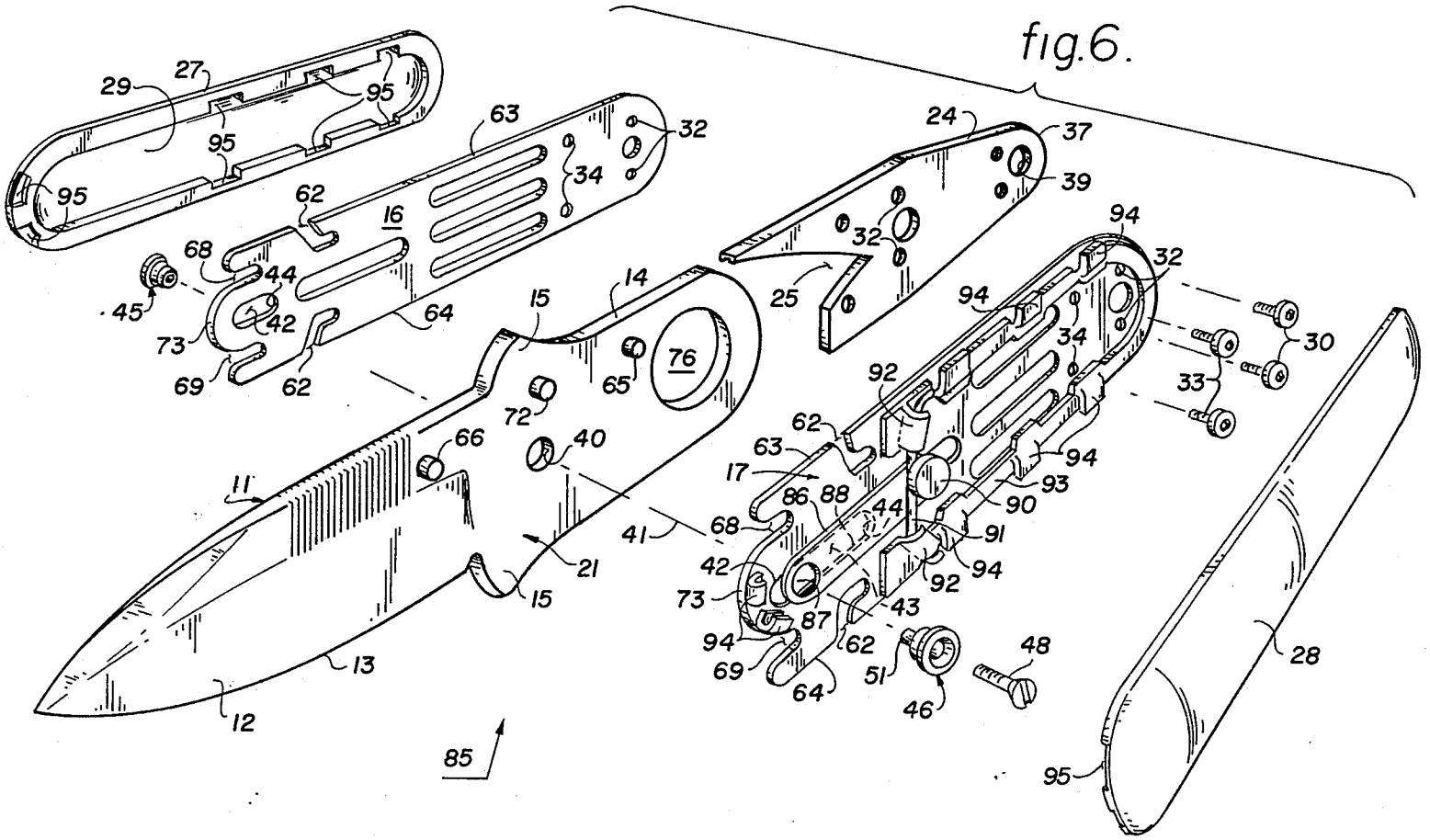
FIG. 6 is an exploded perspective of an alternative embodiment of the invention.

An alternative embodiment 85 of the invention is illustrated in FIG. 6. It may be noted preliminarily that FIG. 6 is viewed from the other side of member 11, over that described above. It should be apparent and understood that the inventive concept comprehends interchangability and adaptability of the elements described above and below, to both sides of member 11.

Each of a pair of scales 16, 17 with their corresponding bayonet slots 62, open-ended slots 68, 69, slots 42, 43 with their extreme surfaces 44, camming surfaces 73, and a spacer 24, are provided in the same manner as described above. The same type of cone-headed bushings 45, 46 are mounted to the scales and to aperture 40 in member 11 and slots 42, 43 in scales 16, 17 as previously described, however, a drawbar 86 having an aperture 87 in alignment with the member's aperture 40 and slots 42, 43 is slidably mounted longitudinally of each of the scales 16, 17. A stationary capstand 90 is mounted on the rear of each drawbar 86. Each capstand 90 captures to its one side the center of a bow spring 91 mounted laterally of its scale and held thereon by means of a pair of spaced hooks 92 formed on a handle receiver 93 secured, as by welding, to each scale 16, 17. Each handle receiver 93 further provides for a multiple number of spaced tabs 94 along each of its outer edges and which project out of its planar nature or body so as to engage corresponding slots 95 of its associated handle side 27, 28 which are securely mounted, as in the earlier described embodiment, upon their corrsponding scale to form the sheath for the tool or knife. Additional tabs 94 are suitably provided along the guide rails 73 of each scale 16, 17 to cooperate with corresponding slots 95 in handle sides 27, 28 in properly seating and disposing the handle sides to their respective scales.

In operation, as member 11 is pulled forwardly by either its exposed blade or tool element, in order to pivot it to expose the other and thence to again lock the blade member to its scales in its sheath, the drawbar's capstand 90 pulls against bow spring 91. The studs 65, 72 and 66 function in the same manner with their corresponding bayonet slots 62 and arcuate camming rails 73 as in the previously described embodiment. Once pivoting motion is complete, bow spring 91 snaps member 11 back into its locked position where in the studs 72 seat in their corresponding open-ended slots 68, 69, as the case may be, and either studs 65 or 66 seat in their corresponding bayonet slots, as the case may be.

In assembly of the first described embodiment, fasteners 30 secure together scales 16, 17 and spacer 24. Member 11 is slipped into the formed pocket, after pins have been press fit thereto to form and locate all of the studs, between the secured scales to align its aperture 40 with slots 42, 43 in scales 16, 17, preferably blade edge 13 facing spacer 24. Cone-head bushings 45, 46 then are mounted together, the front ends of the coiled springs 54, 55 having first been mounted to such bushings via steel wires 57 and their hooks 56. Rear hooks 61 then are attached to stud 60. Thereafter, handle sides 27, 28 are secured upon scales 16, 17, respectively, and clip 36 attached to projection 37 on spacer 24.

In the alternative embodiment, drawbars 86 and members 93 first are fabricated, with members 93 then being welded to scales 16, 17. Bowsprings 91 and drawbars 86 are installed. Fastening of elements then takes place, as described above, while tabs 94 and slots 95 cooperate in the assembling steps.

The aforedescribed elements may be fabricated out of suitable and known materials, such as steel and plastic, through known techniques associated with cutlery, stamping (of metal pieces), plastic molding, welding and spring forming.

Various changes and modifications may be made with out departing from the spirit and scope of the invention. For example, not intended to be all inclusive, the bayonet slots 62 and open-ended slots 69 may be formed only in one of the scales 16, 17, however, for mass production and interchangeability of parts from one tool to another, each scale includes such slots. Also, the device will operate without intermediately-disposed stud or studs 72 co-acting with rail or rails 73, but the camming action achieved by such elements overcomes or facillitates the yielding action of the one-way urging of the coiled spring or springs 54, 55 to provide a smooth rotation or pivot for member 11. With the elimination of camming rail or rails 73, slots 42, 43 remaining in alignment with aperture 40 of member 11, the urging means or coiled springs 54, 55 nevertheless maintain the seating of studs 65, 66 in their corresponding bayonet slots 62; such slots 42, 43 need not be totally closed, as long as their extremes 44 function against bushings 45, 46. And rather than studs 60 for hooking the rear ends of the coiled springs 54, 55 to their respective scales 16, 17, hooks may be stamped out of the scale material itself.

INDUSTRIAL APPLICABILITY

Although the invention is illustrated as an embodiment in the art of knives, it has application in other industrial areas in which fixed manual or mechanical tool elements are desirable.

We claim:

1. A pivotable yet fixed-member tool comprising a pair of longitudinally-extending scales at least a first of said scales including opposing edges, a tool member having sides and having an aperture therein disposed between said scales, said tool member pivotable into one or the other of directions corresponding to the directions for the longitudinally-extending scales, means for urging said tool member in said one of said directions, said scales including slots in alignment with such aperture, means for pivoting said tool member about said scales mounted in said slots and aperture, and means for retaining said tool member in a locked position relative to said scales as a result of urging by said urging means.

2. The tool of claim 1 wherein said urging means comprises a coiled spring operatively connected between said member proximate its aperture and said first of said scales.

3. The tool of claim 1 wherein said urging means includes a pair of coiled springs each disposed over a corresponding one of said scales and being operatively connected between said member proximate its aperture and its corresponding one of said scales.

4. The tool of claim 1 or claim 2 or claim 3 wherein said retaining means comprises slot means formed in each of said opposing edges, and first and second stud means mounted on a first of said sides, the first stud means seating in slot means in one of said opposing edges for one of such directions for said tool member, the second stud means seating in a slot means in the other of said opposing edges for the other of such directions after pivoting of said tool member from said one directions into the other of such directions.

5. The tool of claim 4 wherein each said slot means comprises a bayonet slot.

6. The tool of claim 4 including opposing edges in the second of said scales and wherein the second of said sides includes first and second stud means corresponding in location to said first and second stud means on the first of said sides, and second slot means formed in said edges in the second of said scales, said stud means on the second of said scales cooperating relative to said second slot means in the same way as does said studs on the first of said sides relative to their slot means.

7. The tool of claim 6 wherein each said slot means comprises a bayonet slot.

8. The tool of claim 1 or claim 2 or claim 3 including means for overcoming said urging means as the member pivots into one or the other of its directions.

9. The tool of claim 4 including means for overcoming said urging means as the member pivots into one or the other of its directions.

10. The tool of claim 9 wherein each of said scales includes a frontal end, said overcoming means comprising third stud means intermediately-disposed between said first and second stud means mounted on the first of said sides, and a camming rail mounted on the frontal end of the first of said scales, said third stud means engaging said rail during pivoting of said member, said urging means yielding against such rail engagement.

11. The tool of claim 4 wherein each of said scales includes a frontal end, said retaining means further including (a) a pair of open ended slots spacedly formed in the frontal end of at least the first of said scales, (b) third stud means mounted on the first one of said sides and intermediately-disposed between said first and second stud means, said third stud means seated in the second of said open-ended slots as the first stud means seats in the bayonet slot in one of said opposing edges, said third stud means seated in the first of said open-ended slots as the second stud means seats in the bayonet slot in the other of said opposing edges.

12. The tool of claim 11 including means for overcoming said urging means as said member pivots into one or the other of its directions.

13. The tool of claim 12 wherein said overcoming means comprises said third stud means and a camming rail mounted on the frontal end of the first of said scales, said third stud means engaging said rail during pivoting of said member, said urging means yielding against such rail engagement.

14. The tool of claim 1 or claim 2 or claim 3 wherein said too member has an axis about which it pivots and comprises a knife extending in said one of said directions beyond its axis and a tool element extending in the other of said directions beyond such axis.

15. The tool of claim 4 wherein said tool member has an axis about which it pivots and comprises a knife extending in said one of said directions beyond its axis and a tool element extending in the other of said directions beyond such axis.

16. The tool of claim 5 wherein said tool member has an axis about which it pivots and comprises a knife extending in said one of said directions beyond its axis and a tool element extending in the other of said directions beyond such axis.

17. The tool of claim 6 wherein said tool member has an axis about which it pivots and comprises a knife extending in said one of said directions beyond its axis and a tool element extending in the other of said directions beyond such axis.

18. The tool of claim 7 wherein said tool member has an axis about which it pivots and comprises a knife extending in said one of said directions beyond its axis and a tool element extending in the other of said directions beyond such axis.

19. The tool of claim 8 wherein said tool member has an axis about which it pivots and comprises a knife extending in said one of said directions beyond its axis and a tool element extending in the other of said directions beyond such axis.

20. The tool of claim 9 wherein said tool member has an axis about which it pivots and comprises a knife extending in said one of said directions beyond its axis and a tool element extending in the other of said directions beyond such axis.

21. The tool of claim 10 wherein said tool member has an axis about which it pivots and comprises a knife extending in said one of said directions beyond its axis and a tool element extending in the other of said directions beyond such axis.

22. The tool of claim 11 wherein said tool member has an axis about which it pivots and comprises a knife extending in said one of said directions beyond its axis and a tool element extending in the other of said directions beyond such axis.

23. The tool of claim 12 wherein said tool member has an axis about which it pivots and comprises a knife extending in said one of said directions beyond its axis and a tool element extending in the other of said directions beyond such axis.

24. The tool of claim 13 wherein said tool member has an axis about which it pivots and comprises a knife extending in said one of said directions beyond its axis and a tool element extending in the other of said directions beyond such axis.

25. The tool of claim 1 wherein said urging means comprises a drawbar longitudinally and slidably mounted over at least said first of said scales and having an aperture in alignment with that of said tool member and the slot of said first of said scales for mounting of said pivoting means, a capstand mounted on said drawbar, and a bowspring operatively connected between said capstand and said first of said scales, said bowspring urging said tool member in such one direction.

26. The claim of claim 25 including a handle receiver securely mounted to said first of said scales, said receiver including spaced hooks for holding said bowspring about said capstand.

27. The tool of claim 25 or claim 26 wherein said retaining means comprises slot means formed in each of said opposing edges, and first and second stud means mounted on a first of said sides, the first stud means seating in slot means in one of said opposing edges for one of such directions for said tool member, the second stud means seating in a slot means in the other of said opposing edges for the other of such directions after pivoting of said tool member from one directions into the other of said directions.

28. The tool of claim 27 including opposing edges in the second of said scales and wherein the second of said sides includes first and second stud means corresponding in location to said first and second stud means on the first of said sides, and second slot means formed in said edges in the second of said scales, said stud means on the second of said scales cooperating relative to said second slot means in the same way as does said studs on the first of said sides relative to their slot means.

29. The tool of claim 25 or claim 26 including means for overcoming said urging means as the member pivots into one or the other of its directions.

30. The tool of claim 27 including means for overcoming said urging means.

31. The tool of claim 30 wherein each of said scales includes a frontal end, said overcoming means comprising third stud means intermediately-disposed between said first and second stud means mounted on the first of said sides, and a camming rail mounted on the frontal end of the first of said scales, said third stud means engaging said rail during pivoting of said member, said urging means yielding against such rail engagement.

32. The tool of claim 27 wherein each of said scales includes a frontal end, said retaining means further including (a) a pair of open-ended slots spacedly formed in the frontal end of at least the first of said scales, (b) third stud means mounted on the first one of said sides and intermediately-disposed between said first and second stud means, said third stud means seated in the second of said open-ended slots as the first stud means seats in the bayonet slot in one of said opposing edges, said third stud means seated in the first of said open-ended slots as the second stud means seats in the bayonet slot in the other of said opposing edges.

33. The tool of claim 32 including means for overcoming said urging means as said member pivots into one or the other of its directions.

34. The tool of claim 33 wherein said overcoming means comprises said third stud means and a camming rail mounted on the frontal end of the first of said scales, said third stud means engaging said rail during pivoting of said member, said urging means yielding against such rail engagement.

35. The tool of claim 25 or claim 26 wherein said tool member has an axis about which it pivots and comprises a knife extending in said one of said directions beyond its axis and a tool element extending in the other of said directions beyond such axis.

36. The tool of claim 27 wherein said tool member has an axis about which it pivots and comprises a knife extending in said one of said directions beyond its axis and a tool element extending in the other of said directions beyond such axis.

37. The tool of claim 28 wherein said tool member has an axis about which it pivots and comprises a knife extending in said one of said directions beyond its axis and a tool element extending in the other of said directions beyond such axis.

38. The tool of claim 29 wherein said tool member has an axis about which it pivots and comprises a knife extending in said one of said directions beyond its axis and a tool element extending in the other of said directions beyond such axis.

39. The tool of claim 30 wherein said tool member has an axis about which it pivots and comprises a knife extending in said one of said directions beyond its axis and a tool element extending in the other of said directions beyond such axis.

40. The tool of claim 31 wherein said tool member has an axis about which it pivots and comprises a knife extending in said one of said directions beyond its axis and a tool element extending in the other of said directions beyond such axis.

41. The tool of claim 32 wherein said tool member has an axis about which it pivots and comprises a knife extending in said one of said directions beyond its axis and a tool element extending in the other of said directions beyond such axis.

42. The tool of claim 33 wherein said tool member has an axis about which it pivots and comprises a knife extending in said one of said directions beyond its axis and a tool element extending in the other of said directions beyond such axis.

* * * * *

UNITED STATES PATENT AND TRADEMARK OFFICE

CERTIFICATE OF CORRECTION

PATENT NO. : 4,961,239

DATED : October 9, 1990

INVENTOR(S) : Boyd, Frank M., Sr. et al

It is certified that error appears in the above-identified patent and that said Letters Patent is hereby corrected as shown below:

In col. 8, line 4, -- of such -- should be read after "one".

In col. 8, line 63, "too" should be read as -- tool --.

In col. 10, line 3, "such" should be read as -- said --; and -- of said -- should be read after "one".

In col. 10, line 5, "claim" (first occurrence) should be read as -- tool --.

In col. 10, line 20, -- of said -- should be read after "one".

Signed and Sealed this

Twelfth Day of May, 1992

*Attest:*

DOUGLAS B. COMER

*Attesting Officer*

*Acting Commissioner of Patents and Trademarks*